United States Patent [19]

Demuth et al.

[11] 4,160,532

[45] Jul. 10, 1979

[54] KNOT HOLE BEAM

[75] Inventors: Hans Demuth; Walter Stumpp, both of Winterthur, Switzerland

[73] Assignee: Sulzer Brothers, Ltd., Winterthur, Switzerland

[21] Appl. No.: 809,127

[22] Filed: Jun. 22, 1977

[30] Foreign Application Priority Data

Jul. 2, 1976 [CH] Switzerland ..... 008486/76

[51] Int. Cl.[2] ..... B65H 75/28

[52] U.S. Cl. ..... 242/125.1

[58] Field of Search ..... 242/125.1, 125, 118.5, 242/77.4, 74

[56] References Cited

U.S. PATENT DOCUMENTS 785,386 3/1905 Thornley ..... 242/77.4

1,647,716 11/1927 Payne ..... 242/118.5

FOREIGN PATENT DOCUMENTS 590114 7/1947 United Kingdom ..... 242/118.5

*Primary Examiner*—George F. Mautz

*Attorney, Agent, or Firm*—Werner W. Kleeman

[57] ABSTRACT

A knot hole beam, for instance a warp beam for looms, for winding-up yarns or the like, comprising a winding tube or cylinder provided at its periphery with knot holes, each knot hole possessing an insertion bore serving for the insertion of a bundle of tied together or knotted yarn or thread ends and at least one, therewith merging knot arresting opening of narrower shape than the insertion bore. Between the insertion bore and the knot arresting opening there is provided at least one side of the knot hole edges an arresting projection for the inserted knot. Such arresting projection protrudes towards a line which is axially parallel to the lengthwise axis of the tube and extends through the center of the insertion bore. The arresting projection is situated closer to such axially parallel line than an outer peripheral portion of the knot arresting opening which is situated furthest therefrom.

5 Claims, 18 Drawing Figures

KNOT HOLE BEAM

BACKGROUND OF THE INVENTION

The present invention relates to a new and improved construction of a knot hole beam, for instance a warp beam of a loom, for winding up threads, yarn or other filamentary material or the like, comprising a winding tube or cylinder possesssing at its periphery knot holes, each of the knot holes having an insertion bore serving for the insertion of a bundle of tied together thread or yarn ends and at least one knot arresting opening merging thereat and constructed narrower than the insertion bore.

With prior art knot hole beams, such as disclosed in Schweizerische Technische Zeitschrift, dated Mar. 10, 1949, page 161, and U.S. Pat. No. 785,386, there are proposed two knot arresting openings following the insertion bore which, viewed with respect to the insertion bore, extend in the peripheral direction of the winding tube or cylinder or axially parallel to the winding tube axis and merge with the insertion bore, respectively.

With the first-mentioned course of the knot arresting openings in the peripheral direction the bending strength of the winding tube and its moment of resistance against bending in a direction perpendicular to the axis of the winding tube are relatively markedly reduced. In the presence of more intense traction or tension forces, for instance caused by the warp threads of a loom, which threads are let- or wound-off the knot hole beam (warp beam) during operation, rupture of the winding tube or cylinder can result.

In the case of the second-mentioned course of the knot arresting openings axially parallel to the lengthwise axis of the winding tube, it is indeed so that the bending strength is less affected, however, during operation the knots inserted into the knot arresting opening can slide out relatively easy in the direction of the insertion bore.

SUMMARY OF THE INVENTION

Hence, it is a primary object of the present invention to provide a new and improved construction of knot hole beam, especially a warp beam for looms, which is not associated with the aforementioned drawbacks and limitations of the prior art proposals.

Another specific object of the present invention aims at improving the drawbacks of prior art constructions knot hole beams as related above.

Still a further significant object of the present invention provides a new and improved construction of warp beam for a loom which is relatively simple in construction and design, economical to manufacture, extremely reliable in operation, and not associated with the drawbacks and deficiencies of the prior art structures heretofore considered.

Now in order to implement these and still further objects of the invention, which will become more readily apparent as the description proceeds, the knot hole beam of this development is manifested by the features that between the insertion bore of the knot arresting opening there is provided at least at one side of the knot hole edge an arresting projection for the inserted knot. This arresting projection protrudes in the direction of a line which is directed axially parallel to the lengthwise axis of the winding tube and which line extends through the center of the insertion bore. The arresting projection is situated closer to such axially parallel line than an outer peripheral portion of the knot arresting opening which is situated furthest from such axially parallel line. The inserted knot then can be particularly securely held in the associated knot arresting opening during operation and it can be drawn or pulled by the tension of the related threads by itself in the direction of the center of the knot arresting opening.

There are possible constructional manifestations with comparatively lesser inclined position of the knot arresting openings relative to the axially parallel or paraxial line, wherein the bending strength of the winding tube is only slightly reduced. In this regard compare the structure of FIG. 4 to that of FIG. 3.

The reason for the reduced weakening or attenuation of the moment of resistance with such type knot arresting openings resides in the fact that the course of the force lines and the taking-up of the bending forces due to the bending load as well as their continuous change in direction during operation, is handled more favorably owing to the rotation of the beam, as will be demonstrated by the description to follow.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
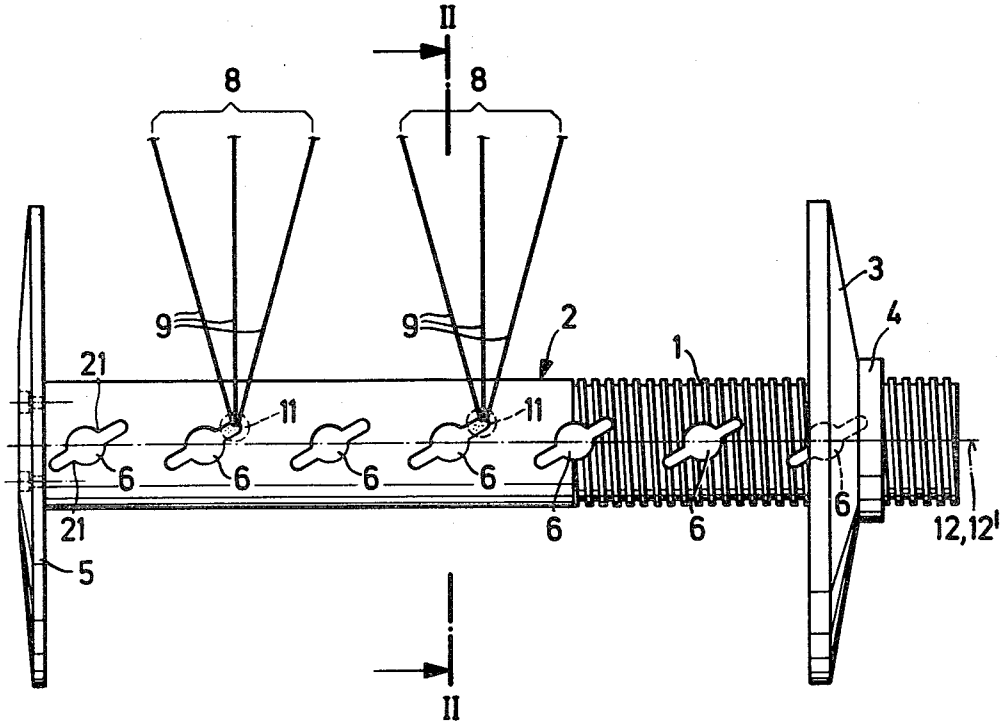
FIG. 1 is a basic view of a knot hole beam constructed according to the teachings of the present invention.

Describing now the drawings, upon the winding tube or cylinder 2 of the warp beam for a loom, illustrated in FIG. 1, there is threaded an outer yarn or thread limiting or bounding disk 3 which is fixedly clamped by means of any suitable and therefore not further illustrated clamping device 4, for instance a clamping ring. At the other end of such winding tube or cylinder 2 there is threadably connected an inner boundary or limiting disk 5.

Figure 2:
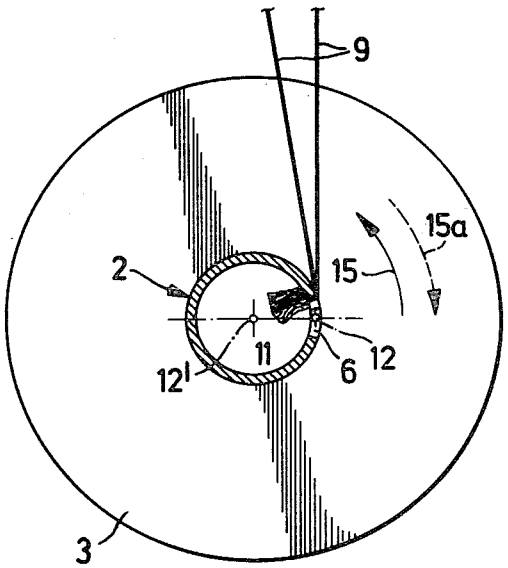
FIG. 2 is an end view thereof.

The winding tube or cylinder 2 or equivalent structure contains at its periphery a number of knot holes, which have been generally designated in their entirety, in FIGS. 1 and 2, by reference character 6.

In the knot holes 6 there are inserted the schematically illustrated bundle 8 of warp thread ends 9 and such are held therein. Each thread or yarn bundle 8 and the associated warp thread ends 9 are knotted together by a knot 11 schematically indicated in broken or dotted lines in FIG. 1. The lengthwise axis of the winding tube or cylinder 2 has been designated by reference character 12'.

Figure 3:
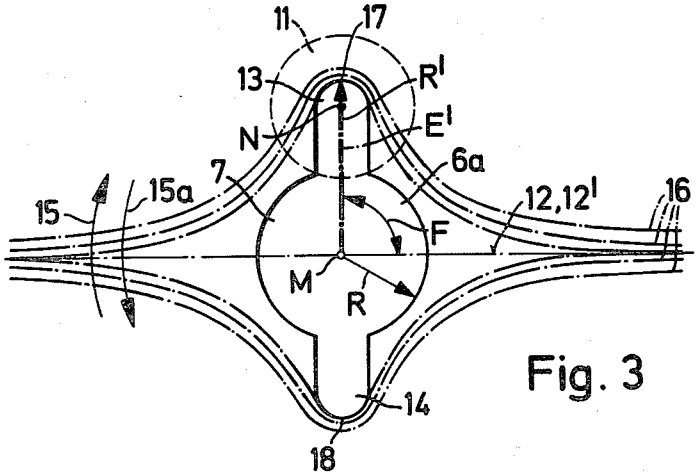

As shown in FIG. 3, the knot hole **6*a* contains a substantially circular bore 7 (radius R) for the insertion of a knot 11 and the warp thread ends 9 of a respective thread bundle 8. At the top and bottom of FIG. 3, the insertion bore 7 continues in the form of two slots 13** and 14. The knot 11 inserted into the bore 7 can be shoved beneath one of such slots 13 and 14 and thus arrested against sliding out. With the indicated arrangement of the warp thread ends 9 or warp threads and the rotational direction, according to the arrow 15 (for loom operation=winding-off of the warp beam or let-off motion), or rotational direction according to arrow 15*a* (for warping operation=winding-up of the warp beam) the knot 11 is to be shoved beneath the arresting slot 13, and with the opposite arrangement the warp threads (in FIG. 2, incoming from below) are to be inserted into the slot 14. With the prior art embodiment of FIG. 3 the knot arresting slots 13 and 14 extend from the insertion bore 7 in the peripheral direction of the winding tube or cylinder 2 generally indicated by the axis 12'. The center M of the insertion bore 7 and the center N of the arresting location of the knot 11 in the arresting slot 13 are located along a connection line E' which, together with a line 12 which is parallel to the tube axis 12' and which so-called axially parallel line 12 extends through the center M, forms an angle F of 90°. The slot 14 is also correspondingly arranged.

During operation, the winding tube or cylinder 2 experiences a tension load or stress (bending load or stress) which is upwardly directed in FIGS. 1 and 2 and thus has exerted thereon a bending moment. The force lines 16 which arise from such tension stress in the material of the winding tube 2 have been shown in FIG. 3. These force lines 16 are markedly bunched or forced together at locations 17, 18 owing to the knot arresting slots 13, 14, so that at such locations load peaks 10 appear in the material of the winding tube 2 and can relatively easily lead to rupture of the winding tube 2.

Figure 4:
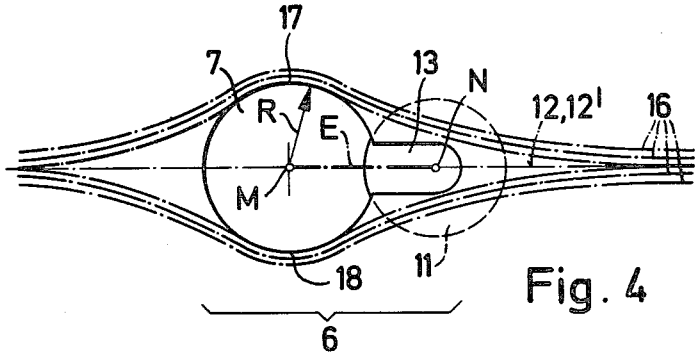
FIGS. 3 and 4, show for comparative purposes, arrangements of knot holes of prior art knot hole beams.

With the heretofore known prior art embodiment of FIG. 4 the single knot arresting slot 13 extends from the insertion bore 7 in the direction of the axially parallel line 12 (angle between E and 12=0). The spacing (radius R) of the location 17 of maximum deflection of the force lines 16 is appreciably shorter than the corresponding spacing R' of the arrangement of FIG. 3. Therefore, the permissible bending moment is greater for the embodiment of FIG. 4 than that of FIG. 3.

Figure 5:
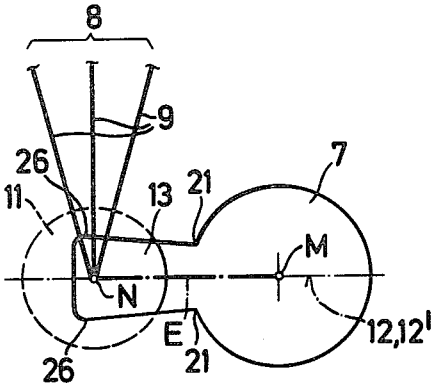

With the embodiment of FIG. 5 the single knot arresting slot 13 again extends substantially parallel to the axially parallel line 12 (angle between E and 12=0). However, there are provided between the insertion bore 7 and the knot arresting slot 13 two arresting projections 21 which extend towards the axially parallel line 12, and to each side of the knot hole edge or flange there is located one such projection. These projections 21 are situated closer to the axially parallel line 12 than the outer peripheral portions 26 of the slot 13 which are furthest removed therefrom, so that there is prevented any sliding-out of the knot 11.

Figure 6:
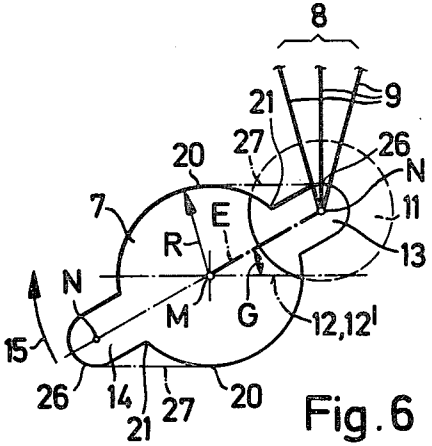
FIGS. 5 to 18 respectively show different exemplary embodiments constructed according to the present invention.

In the embodiment of FIG. 6 there are employed two oppositely situated, knot arresting slots 13 and 14 which are located at an inclination to the axis 12 (angle G between E and 12), and which slots at locations 26 are only guided up to the boundary lines 27 parallel to the axis 12. The force lines are thus not appreciably more strongly bunched or forced together at locations 26 than at locations 20. Owing to the mentioned inclined position, the knots 11 are drawn towards the slot ends during operation. With this embodiment there is provided at each arresting slot 13, 14 an arresting projection 21 only at the side of the flange or edge of the knot hole 6, each such arresting projection being situated closer to the axially parallel line 12 than the associated peripheral portion 26.

Figure 7:
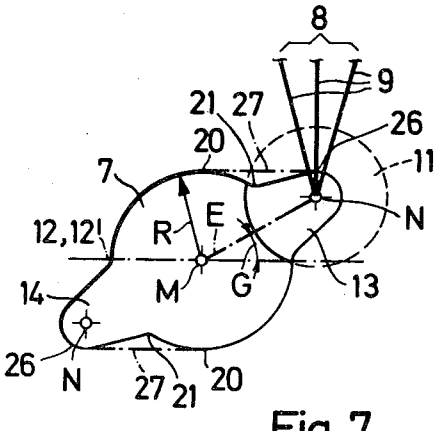

In the embodiment of FIG. 7 the inclined positioned slots 13 and 14 (angle G between E and 12) extend in a narrowed or tapered fashion, and specifically, in the reverse sense than with the arrangement of FIG. 5. The knots 11 are held by projection 21 and the inclined position against sliding-out.

Figure 8:
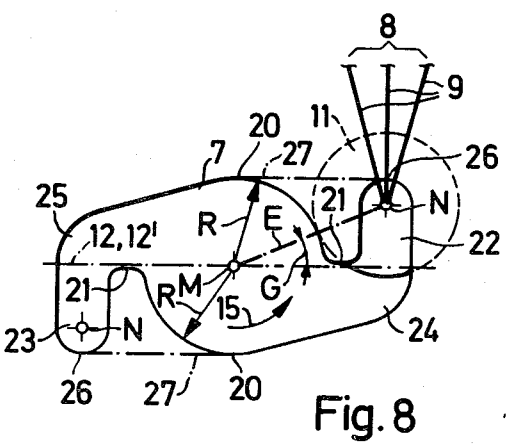

With the embodiment of FIG.8 the slots 22 and 23 are flexed or bent as shown at locations 24 and 25, respectively. Slot 22 is flexed in the direction of the warp threads, the slots 23 opposite thereto. The latter should be employed in the case of a reverse thread arrangement.

Figure 9:
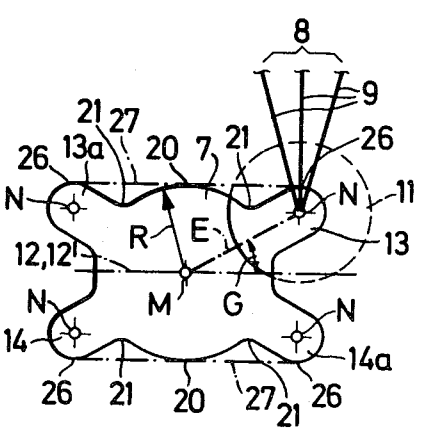

With the embodiment of FIG. 9 there are provided, apart from the knot arresting slots 13 and 14, two further slots 13*a* and 14*a* respectively. By virtue of the foregoing there are present still further possibilities of displacing the inserted parts 11, 9, for instance for the case that the tension forces at the side of the warp threads extend more or less at an inclination to the axis 12.

Figure 10:
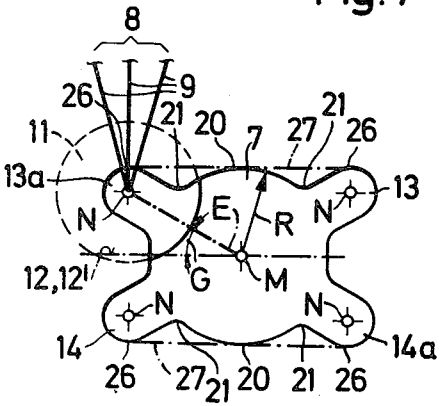

FIG. 10 corresponds to the arrangement of FIG. 9, however here the knot 11 is inserted into the slot 13*a*.

Figure 11:
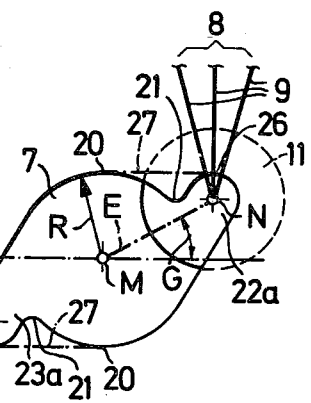

With the embodiment of FIG. 11 there are provided only short recesses 22*a* and 23*a* corresponding approximately to the slots 22 and 23 of FIG. 8. The parts 11 and 9 are held by the projection 21 and the yarn or thread tension.

Figure 12:
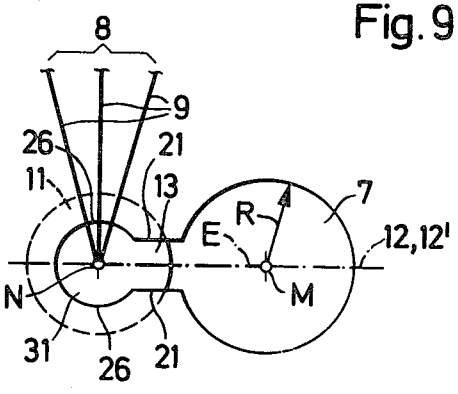

With the construction of FIG. 12 the single knot arresting slot 13 continues into a circular recess 31. To prevent sliding back of the knot 11 towards the right there are provided the projections 21, although the slot 13 extends parallel to the axis 12 (angle between E and 12=0).

Figure 13:
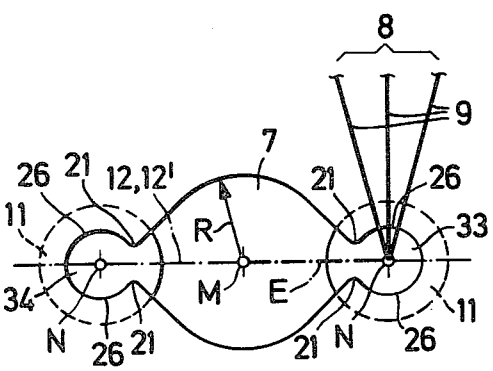

In the arrangement of FIG. 13 there are provided two substantially circular-shaped knot arresting recesses 33, 34 which are disposed in the direction of the axially parallel line 12 (angle between E and 12=0). By means of the projections 21 it is possible to prevent sliding-out of the knob 11.

Figure 14:
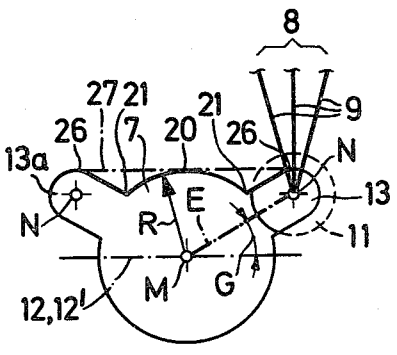

With the arrangement of FIG. 14 both of the inclined positioned arresting slots 13, 13*a* (angle G between E and 12) are arranged at the same side with respect to the axis 12 for the purpose of selection of the insertion of the knot 11.

Figure 15:
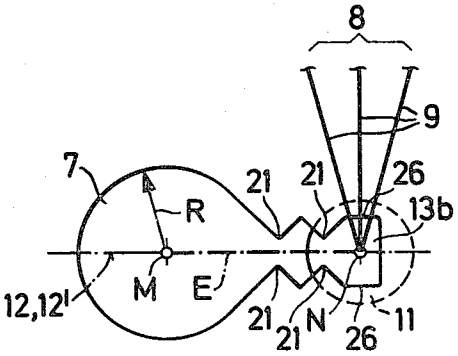

With the embodiment of FIG. 15 the parallel arresting slot 13*b* (angle between E and 12=0) is provided at both sides of the flanges or edges of the knot hole with a number of projections 21 to prevent any sliding-out of the knot 11.

Figure 16:
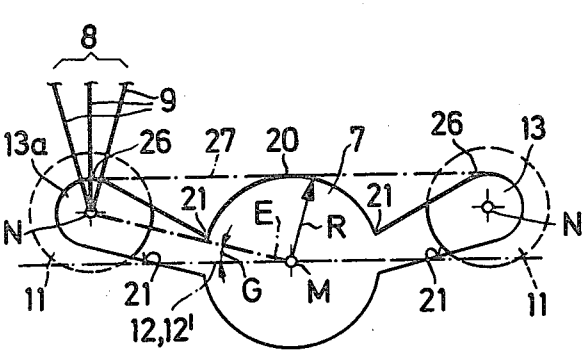

With the arrangement of FIG. 16 the slots 13 and 13*a*, which correspond to the arrangement of FIG. 14, are of tapered configuration, in order to prevent sliding-out of the knot 11 by means of the projections 21.

Figure 18:
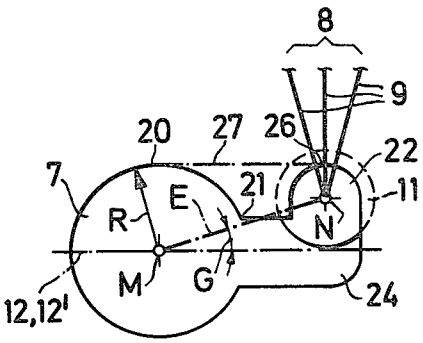
Figure 17:
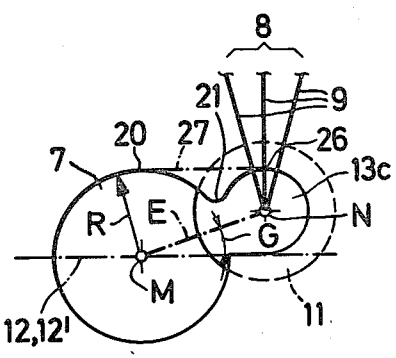

With the showing of FIG. 17 there is an arrangement having only a substantially circular, inclined positioned recess 13*c* (angle G between E and 12) for knot arresting purposes, whereas with the arrangement of FIG. 18 there is provided a parallel, but flexed or bent slot 22 (angle G between E and 12).

In all instances of the inventive constructions of the knot holes the angle G between the connection line E of the center M of the insertion bore 7 with the center N of the arresting location of the knot 11 and the axial parallel lines 12 deviates from 90°, preferably amounts to a value of 0° to approximately 30°. Of course, below the center N of the arresting location of the knot 11 there should be understood that there is provided an intermediate region towards the end of the arresting slot, in which there is positioned a fitting knot of the jointed together warp thread ends. Depending upon the size of the knot and the available warp thread material the center N may possess slight positional changes.

The invention can be employed in conjunction with any winding beam, in the first instance for the warp beam of a loom, but also for warp beams of warp knitting machines or other machines employed in finishing work, for instance dyeing plants or the like. Instead of working yarn or threads, there can be wound-up upon the beam also wires, glass fiber material or the like. The insertion bore 7 can be constructed, for instance, also to be many-cornered or many-sided, for instance hexagonal, or have other shapes. What has been indicated heretofore correspondingly is valid also for the arresting slots 13, 14 and so forth, to the extent that at least one arresting projection 21 is provided between the insertion bore and the knot arresting slot.

While there are shown and described present preferred embodiments of the invention, it is to be distinctly understood that the invention is not limited thereto, but may be otherwise variously embodied and practiced within the scope of the following claims.

Accordingly, what we claim is:

1. A knot hole beam, especially a warp beam for a loom, for winding-up yarn or the like, comprising:

a winding tube having a lengthwise axis and a peripheral portion provided with knot holes;

an insertion bore serving for the insertion of a bundle of knotted together yarn ends provided for each knot hole;

means for providing at least one knot arresting opening merging with the insertion bore and being narrower than said insertion bore;

an arresting projection provided for each knot hole for the inserted knot, said arresting projection being disposed between the insertion bore and the knot arresting opening at least at one side of an edge of the knot hole and extending towards a line which is substantially axially parallel to the lengthwise axis of the winding tube, said axially parallel line passing through the center of the insertion bore;

said arresting projection being situated closer to said axially parallel line than an outer peripheral portion of the knot arresting opening which is situated furthest from such axially parallel line; and the arresting projection being formed by an inclined arrangement of the sides of the knot arresting opening relative to the axially parallel line.

2. The knot hole beam as defined in claim 1, wherein:

a peripheral side portion of the knot arresting opening, in the peripheral direction of the warp beam, is located at most at the same height as a peripheral side portion of the insertion bore.

3. A knot hole beam, especially a warp beam for a loom, for winding-up yarn or the like, comprising:

a winding tube having a lengthwise axis and a peripheral portion provided with knot holes;

an insertion bore serving for the insertion of a bundle of knotted together yarn ends provided for each knot hole;

means for providing at least one knot arresting opening merging with the insertion bore and being narrower than said insertion bore;

an arresting projection provided for each knot hole for the inserted knot, said arresting projection being disposed between the insertion bore and the knot arresting opening at least at one side of an edge of the knot hole and extending towards a line which is substantially axially parallel to the lengthwise axis of the winding tube, said axially parallel line passing through the center of the insertion bore;

said arresting projection being situated closer to said axially parallel line than an outer peripheral portion of the knot arresting opening which is situated furthest from such axially parallel line; and side walls of a portion connecting the insertion bore with the knot arresting opening being flexed whereby the knot arresting opening extends in a direction essentially transverse to said axially parallel line.

4. A knot hole beam, especially a warp beam for a loom, for winding-up yarn or the like, comprising:

a winding tube having a lengthwise axis and a peripheral portion provided with knot holes;

an insertion bore serving for the insertion of a bundle of knotted together yarn ends provided for each knot hole;

means for providing at least one knot arresting opening merging with the insertion bore and being narrower than said insertion bore;

an arresting projection provided for each knot hole for the inserted knot, said arresting projection being disposed between the insertion bore and the knot arresting opening at least at one side of an edge of the knot hole and extending towards a line which is substantially axially parallel to the lengthwise axis of the winding tube, said axially parallel line passing through the center of the insertion bore;

said arresting projection being situated closer to said axially parallel line than an outer peripheral portion of the knot arresting opening which is situated furthest from such axially parallel line;

each said insertion bore and said at least one knot arresting opening having a respective center interconnected by a connection line; and the angle between said connection line and said axially parallel line deviating from 0° and 90°.

5. The knot hole beam as defined in claim 4, wherein: said angle amounts to a value of approximately 30°.

* * * * *